US006571922B1

(12) United States Patent
Ruhmanseder

(10) Patent No.: US 6,571,922 B1
(45) Date of Patent: Jun. 3, 2003

(54) BRIEFCASE USABLE AS A WRITING DESK

(76) Inventor: Rudolf Ruhmanseder, Im Himmelreich 180, A 4792 Münzkirchen (AT)

( * ) Notice: Subject to any disclaimer, the term of this patent is extended or adjusted under 35 U.S.C. 154(b) by 0 days.

(21) Appl. No.: 10/048,188

(22) PCT Filed: Aug. 25, 2000

(86) PCT No.: PCT/AT00/00227

§ 371 (c)(1),
(2), (4) Date: Jan. 25, 2002

(87) PCT Pub. No.: WO01/17388

PCT Pub. Date: Mar. 15, 2001

(30) Foreign Application Priority Data

Sep. 3, 1999 (AT) ..... 1519/99

(51) Int. Cl.[7] ..... A45C 9/00; A45C 15/06

(52) U.S. Cl. ..... 190/11; 190/111; 190/900; 190/902; 108/25; 108/43

(58) Field of Search ..... 190/11, 111, 900; 108/25, 38, 43; 312/244

(56) References Cited

U.S. PATENT DOCUMENTS

| | | | | | |
|---|---|---|---|---|---|
| 791,506 | A | * | 6/1905 | Simmons | 190/111 X |
| 1,445,566 | A | * | 2/1923 | Stoll | 190/11 |
| 1,844,336 | A | * | 2/1932 | Ritter, Jr. | 190/111 X |
| 2,180,191 | A | * | 11/1939 | Bauch | 190/111 |
| 2,211,660 | A | * | 8/1940 | Kidd et al. | 190/11 X |
| 4,244,632 | A | | 1/1981 | Molinari | 190/18 X |
| 4,314,625 | A | | 2/1982 | Sarna et al. | 190/16 |
| 4,420,270 | A | | 12/1983 | Rossello | 190/900 X |
| 4,538,861 | A | * | 9/1985 | Hughes, Jr. | 190/11 X |
| 4,700,634 | A | | 10/1987 | Mills et al. | 190/11 X |
| 5,086,378 | A | * | 2/1992 | Prince | 362/800 X |
| 5,215,172 | A | | 6/1993 | Stevenson | 190/1 X |
| 5,447,215 | A | * | 9/1995 | Volkmar et al. | 190/11 |
| 5,833,352 | A | * | 11/1998 | Goodwin | 362/156 |
| 5,979,337 | A | * | 11/1999 | Clark et al. | 108/43 |

FOREIGN PATENT DOCUMENTS

| | | | |
|---|---|---|---|
| FR | 550632 | * 12/1922 | 190/11 |
| FR | 2 689 734 | 4/1994 | |
| WO | 91 15133 | 10/1991 | 190/11 |

* cited by examiner

*Primary Examiner*—Sue A. Weaver
(74) *Attorney, Agent, or Firm*—Collard & Roe, P.C.

(57) ABSTRACT

A briefcase is described, comprising a case body consisting of a frame (1) made up of a base (2), an upper frontal wall (4) which lies opposite said base (2) and side frontal walls (3) between the base (2) and the upper frontal wall (4), as well as a back wall (5) and a front wall (6) which can be opened. To create advantageous handling characteristics, it is proposed that the front wall (6) of the base body, which rests on the back wall (5), forms an inclined surface which is sloped from the base (2) to the upper frontal wall (4) and has two laterally adjacent cover sections (7, 8) which are mounted in such a way that they can swing open about the edges pointing towards each other and extending in the direction of the height of the front wall (6).

6 Claims, 3 Drawing Sheets

BRIEFCASE USABLE AS A WRITING DESK

CROSS REFERENCE TO RELATED APPLICATIONS

Applicant claims priority under 35 U.S.C. §119 of Austrian Application No. A 1519/99 filed Sep. 3, 1999. Applicant also claims priority under 35 U.S.C. §365 of PCT/AT00/00227 filed Aug. 25, 2000. The international application under PCT article 21 (2) was not published in English.

BACKGROUND OF THE INVENTION

1. Field of the Invention

The present invention relates to a briefcase, comprising a case body consisting of a frame made-up of a base, an upper frontal wall which lies opposite said base and side frontal walls between the base and the upper frontal wall and a back wall and a front wall which can be opened.

2. Description of the Prior Art

With briefcases of this type the front wall forms a cover which is joined to the base of the case body, so that this cover formed by the front wall can be easily swung up, whenever the case body is resting on its back wall. If, because of the lack of a table surface, such briefcases are used as a writing pad or as support for work papers, in that the case body is rested on the upper leg in the sitting position for example, difficulties arise because the back and front walls run parallel. This means that the front wall of the case body resting on the upper legs falls away from the body in a normal sitting position, when the knee is not raised and an unnatural sitting position is assumed. Furthermore, any attempt to open the front wall is hindered by the work documents lying thereon, which have to be held on to awkwardly when the front wall is swung up about a swivel axis parallel to the ground.

To attain an inclined surface with briefcases, it is known (FR 2 689 734 A1) to provide a desk board on the back wall of the case body, which can be folded about an axis parallel to the edge into a work position when the briefcase is lying flat and can be supported in this work position by a support flap relative to the back wall. The disadvantage of these known briefcases is not only the additional expense created by the desk board, but also the fact that the interior of the briefcase is difficult to access after the desk board is folded back, without jeopardising the position of the documents lying on the desk board.

To be able to advantageously display documents which can be packed in a briefcase, it is also known (U.S. Pat. No. 4,314,625 A) to provide a desk board which can swing inwards to the front wall on the front wall of the case body, which can be folded out when the front wall is swung up and supported on the case body, creating a corresponding inclined surface, on which the documents to be shown are kept well in sight. Similarly, it is known in another construction (U.S. Pat. No. 4,420,270 A) to display visual material which is kept on a desk board as in a ring binder, which can be swung into a case body. Because the desk board is joined to the swinging front wall of the case body, the front wall forms a swing support for the desk board, which is displaced from the swung-in rest position into the folded-out work position with the aid of a tie. The drawback to these constructions is that the case body is only meant for accommodating the documents to be displayed and consequently cannot be utilised as a briefcase for storing other documents.

SUMMARY OF THE INVENTION

The aim of the invention is to provide a briefcase of the type described at the outset, such that it can be used advantageously as a writing pad, without having to forego a comfortable sitting position or easy access to the briefcase interior while the case body is being used as a paper pad.

The invention solves this task by the fact that the front wall of the case body resting on the back wall forms an inclined surface which is sloped from the base to the upper frontal wall and has two laterally adjacent cover sections which are mounted in such a way that they can swing open about the edges pointing towards each other and extending in the direction of the height of the front wall.

Designing the front wall as a desk surface, which when the case body is rested on its back wall slopes from the base of the case body to the upper frontal wall, provides a beneficial writing pad which also enables favourable ergonometric conditions for someone writing in a sitting position when the case body is set on their thigh. Despite the frontal wall being designed as a sloping inclined surface the contents of the briefcase can be accessed easily via two laterally adjacent cover sections, because these cover sections are mounted in such a way that they can swing open about the edges pointing towards each other, so that papers laid on the inclined surface can remain in the vicinity of one cover section, while the other cover section is opened up from the associated side frontal wall of the case body. These cover sections which can swing towards one another act like envelopes when opened at the same time, between which the documents resting on the inclined surface are folded up together like a book, easily preventing papers from unavoidably sliding off the inclined surface. Since normal file documents are oriented in size to generally accepted paper formats, then in practice subdividing the front wall into two adjacent cover sections barely causes any restrictions with respect to the contents of the briefcase to be accommodated.

To prevent papers laid on the desk surface of the front wall from sliding off due to inclination of the desk, it is recommended to provide the upper frontal wall with a limit stop projecting over the inclined surface, which ensures that papers laid thereon are held back accordingly, without impairing handling of the briefcase, because the overhang of the limit stop over the desk surface can be comparatively small.

Although both cover sections of the front wall can be joined to a web bridging the briefcase opening, structural conditions are particularly advantageous if they are joined to a partition dividing the case body, as this partition creates front wall support resistant to bending in its middle region, which is of benefit to the support function of the desk surface. In this connection it must be considered that the case body should be as light as possible.

The desk function of the briefcase can be complemented advantageously by lighting for the inclined surface, in such a way that the case body can form a floor compartment defined by an intermediate bottom for accommodating such a pull-out lighting unit for the desk surface If required, this floor compartment is opened and the lighting unit is withdrawn from the floor compartment to provide adequate illumination for the desk surface. If light-emitting diodes arranged on a beam are used for illumination, the advantages of a comparatively small energy consumption can be associated with those of minimal heat generation, without having to sacrifice adequate light strength. If the beam is arranged to swivel, the direction of illumination can also be adjusted.

BRIEF DESCRIPTION OF THE DRAWING

The inventive object is illustrated by way of example in the diagram, in which.

DESCRIPTION OF THE PREFERRED EMBODIMENT

Figure 1:
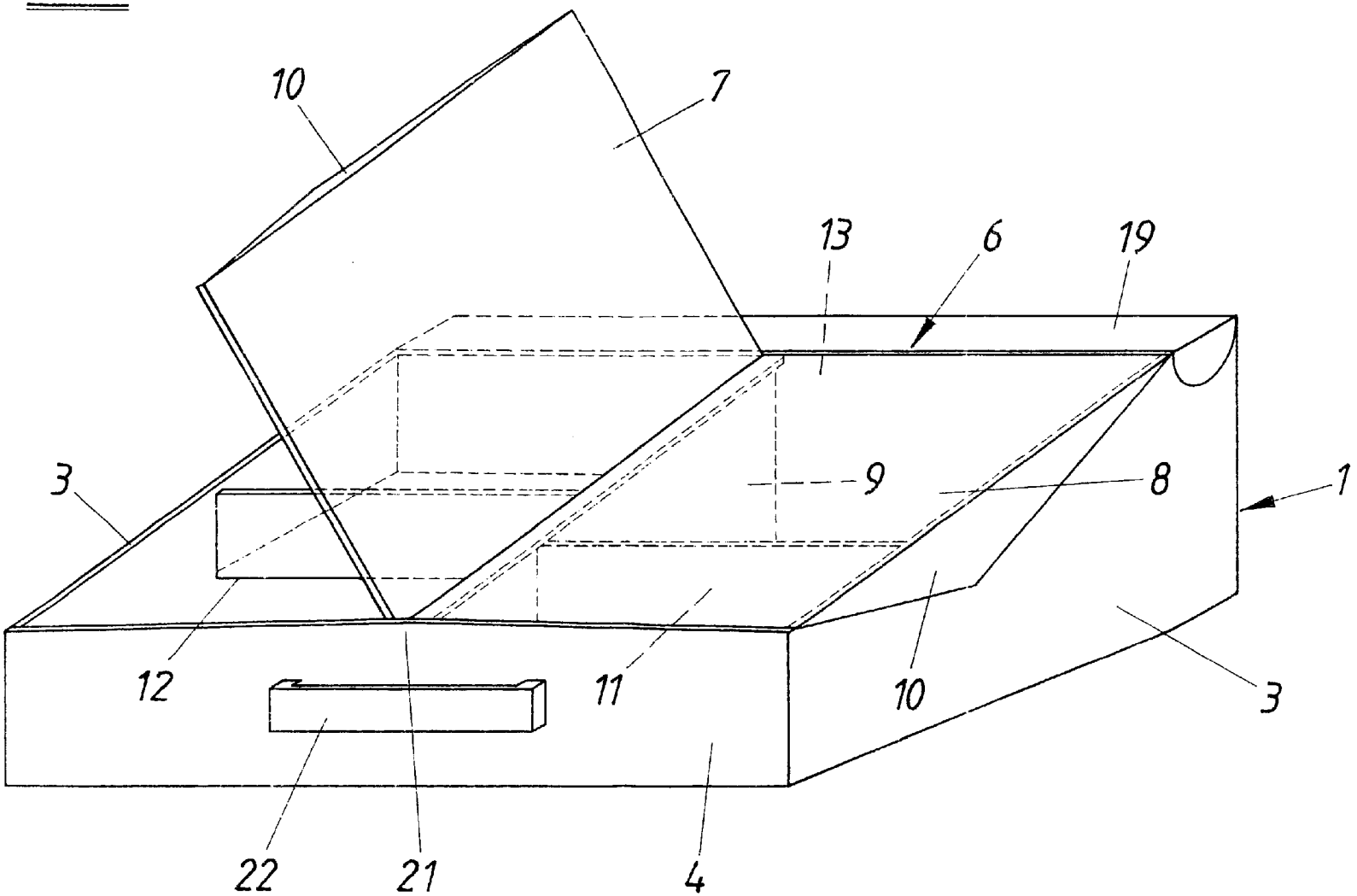
FIG. 1 shows a briefcase resting on its back wall according to the present invention in an axonometric representation.

The case body of the briefcase shown in a lying position comprises a rigid frame 1, formed by a base 2, two side frontal walls 3 projecting from base 2 and an upper frontal wall 4 connecting side frontal walls. On its rear side frame 1 is closed by a back wall 5 and on its front side bears a front wall 6 which can be opened and has two cover sections 7 and 8. These cover sections 7 and 8 are joined to a partition 9 parallel to side frontal walls 3 and at their edges resting on side frontal walls 3 of frame 1 bear closing flaps 10 which overlap side frontal walls 3 and can be secured to said frontal walls 3 by way of push buttons, for example.

It is understood, however, that other forms of closure can easily be employed.

Partition 9 divides the case body into two take-up spaces each accessible via cover sections 7 and 8, which can again be subdivided. While the briefcase space which can be closed by cover section 8 is divided by a partition 11 parallel to the bottom, an internal partition 12 substantially parallel to back wall 5 forms, in the vicinity of cover section 7, internal partitioning which allows a retaining space to be utilised, extending over the entire back wall 5 in the vicinity of cover section 7.

Figure 2:
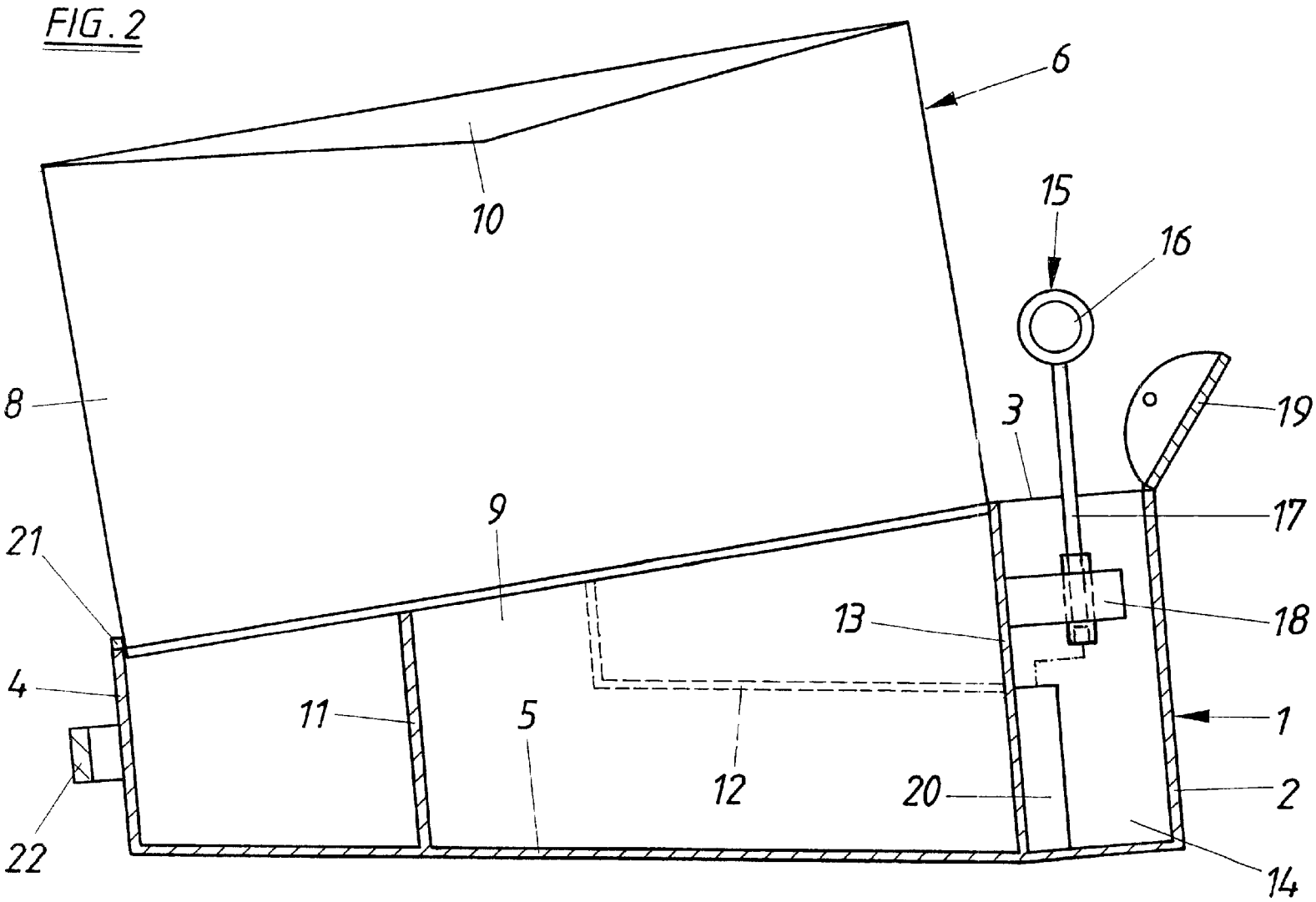
FIG. 2 shows this briefcase in cross-section and FIG. 3 shows the briefcase according to FIG. 2 in a view of the upper front wall.

As is evident especially from FIG. 2, a floor compartment 14 is divided off by an intermediate bottom 13 from the rest of the case body which houses a lighting unit 15 in the form of a beam 16 fitted with light-emitting diodes. Said beam 16 is held displaceably by guides 17 in a console 18, so that after a cover 19 occluding floor compartment 14 is opened up, lighting unit 15 can be taken out from floor compartment 14 into the use position illustrated in FIG. 2. The power is supplied to lighting unit 15 by batteries 20 which are housed in floor compartment 14, in such a way that due to beam 16 being fitted with light-emitting diodes minimal energy consumption and thus long light life is provided for. By tilting beam 16 the direction of illumination can be adapted to respective requirements.

When cover sections 7 and 8 are closed front wall 6 of the case body resting on back wall 5 forms an inclined surface which is sloped from base 2 to upper frontal wall 4, which can be used advantageously as a writing pad or support for work papers. Documents resting on this inclined surface barely hamper access to the interior of the briefcase, since each of cover sections 7 and 8 can be opened, such that documents can remain lying on the unopened cover section.

Figure 3:
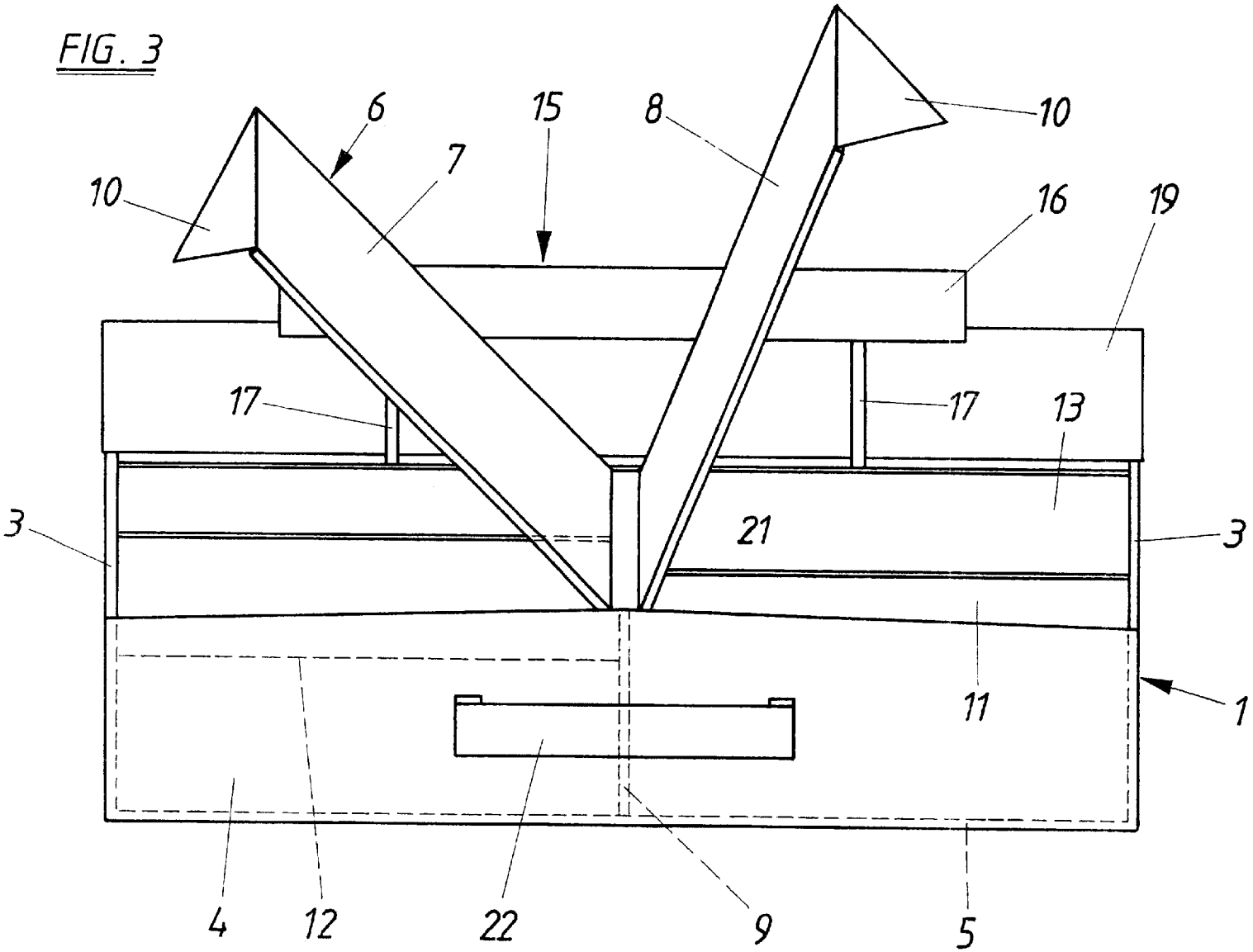

Even when both cover sections 7 and 8 are opened the documents lying on the desk are held between cover sections 7 and 8 as though in an envelope, as evident from FIG. 3, which illustrates both cover sections 7 and 8 in a partially open position.

So that papers resting on the inclined surface cannot slide over upper frontal wall 4 from front wall 6, upper frontal wall 4 projects over the inclined surface to form a limit stop 21, as is evident especially from FIG. 2. Papers lying on the desk surface are easily prevented from sliding off by said limit stop 21. When cover sections 7 and 8 are closed and floor compartment 14 is closed the briefcase can be handled like any conventional briefcase and be carried by means of a handle 22 located in the vicinity of upper frontal wall 4.

The invention is understandably not limited to the illustrated embodiment. The case body can be partitioned off in various ways by partitions and compartment floors, according to requirements. It is critical that an inclined surface which is sloped from base 2 to upper frontal wall 4 is formed by both cover sections 7 and 8 of front wall 6 which can be folded towards one another, whenever the case body rests on back wall 5.

What is claimed is:

1. A briefcase comprising a case body consisting of a frame composed of a base, an upper frontal wall opposite the base, two side walls extending between the base and the upper frontal wall, the side walls being opposite each other, a back wall on which the case body may be rested and a front wall opposite the back wall, the front wall forming an inclined rigid surface sloping down from the base to the upper frontal wall and comprising two laterally adjacent front wall sections covering the case body, the front wall sections being pivotal about adjacent edges extending transversely to the base and opposite upper frontal wall for opening the case body.

2. The briefcase of claim 1, wherein the upper frontal wall has a limit stop projecting beyond the front wall.

3. The briefcase of claim 1, comprising a partition wall dividing the case body into two compartments, the front wall sections being pivoted to the partition wall.

4. The briefcase claim 1, comprising an intermediate wall defining a compartment with the base in the case body, and an extensible lighting unit for the inclined rigid surface, housed in the compartment.

5. The briefcase of claim 4, wherein the lighting unit comprises light-emitting diodes arranged on a beam.

6. The briefcase of claimed 5, wherein the beam is rotatably mounted in the compartment.

* * * * *